US011510842B2

(12) United States Patent
Rohloff

(10) Patent No.: US 11,510,842 B2
(45) Date of Patent: Nov. 29, 2022

(54) ERGONOMIC AMBULATION ASSIST DEVICE

(71) Applicant: Delphine HC Innovations, LLC, Daytona Beach, FL (US)

(72) Inventor: Rose M. Rohloff, Daytona Beach, FL (US)

(73) Assignee: Delphine HC Innovations, LLC, Daytona Beach, FL (US)

( * ) Notice: Subject to any disclaimer, the term of this patent is extended or adjusted under 35 U.S.C. 154(b) by 0 days.

(21) Appl. No.: 16/927,410

(22) Filed: Jul. 13, 2020

(65) Prior Publication Data

US 2021/0015695 A1 Jan. 21, 2021

Related U.S. Application Data

(60) Provisional application No. 62/875,305, filed on Jul. 17, 2019.

(51) Int. Cl.
*A61H 3/04* (2006.01)
*A61H 3/00* (2006.01)

(52) U.S. Cl.
CPC ..... *A61H 3/04* (2013.01); *A61H 2003/003* (2013.01); *A61H 2003/006* (2013.01)

(58) Field of Classification Search
CPC ..... A61H 3/04; A61H 2201/1633; A61H 2003/006; A61H 2201/0149
See application file for complete search history.

(56) References Cited

U.S. PATENT DOCUMENTS 1,448,783 A * 3/1923 Blewitt ..... A61H 3/04 297/6
2,733,754 A * 2/1956 Leslie et al. ..... A61H 3/04 297/6

(Continued)

FOREIGN PATENT DOCUMENTS

WO WO 2003/062038 A1 7/2003

OTHER PUBLICATIONS

Amazon.com, "Drive Medical 10257BL-1 Four Wheel Walker Rollator with Fold Up Removable Back Support," Web Page, <URL:https://www.amazon.com/drive-medical-rollator-removable-support/dp/B00NFJX0PU/ref=sr_1_5_a_it?ie=UTF8&qid-1511399570&sr=8-5&keywords=walkers&th=1/>; Published Nov. 22, 2011, Retrieved from Internet Dec. 29, 2020 (10 pages).

(Continued)

*Primary Examiner* — Noah Chandler Hawk
(74) *Attorney, Agent, or Firm* — Invention Mine LLC

(57) ABSTRACT

An ergonomic walking assistance device is disclosed. The walking assistance device includes a pair of front struts. Each of the front struts include a leg and an angled section. Each of the legs support a footing device in contact with the ground. The device includes a pair of rear struts. Each of the rear struts include a leg and a cylindrical section. Each of the leg support a footing device in contact with the ground. A pair of side supports are provided that each connecting the front struts to the rear struts. A U-shaped lateral section connects the forward struts with the rear struts. The lateral section includes a pair of arm members extending on each side of the user. A frame is defined by the lateral section and forward and rear struts, allowing access between the forward struts for a user of the device.

20 Claims, 7 Drawing Sheets

(56) References Cited

U.S. PATENT DOCUMENTS

| | | | | | |
|---|---|---|---|---|---|
| 2,798,533 | A * | 7/1957 | Frank | A61H 3/00 297/6 |
| 3,625,237 | A | 12/1971 | Wertz | |
| 4,251,105 | A * | 2/1981 | Barker | A61H 3/04 297/6 |
| 4,748,994 | A * | 6/1988 | Schultz | A61H 3/04 135/67 |
| 5,364,120 | A * | 11/1994 | Shimansky | A61G 5/00 280/47.2 |
| 5,564,451 | A * | 10/1996 | Hagberg | A61H 3/02 135/68 |
| 6,338,493 | B1 | 1/2002 | Wohlgemuth | |
| 6,595,530 | B2 | 7/2003 | Wood | |
| 6,733,018 | B2 | 5/2004 | Razon | |
| 6,837,503 | B2 * | 1/2005 | Chen | A61H 3/04 280/47.4 |
| D501,432 | S | 2/2005 | Moller | |
| 7,494,138 | B2 * | 2/2009 | Graham | A61G 5/08 280/304.5 |
| 7,494,139 | B2 * | 2/2009 | Turner | A61H 3/04 135/67 |
| 8,292,310 | B2 * | 10/2012 | Turner | A61H 3/04 280/47.35 |
| 9,375,380 | B2 | 6/2016 | Jowett | |
| 9,662,264 | B2 * | 5/2017 | Jacobs | A61H 3/04 |
| 10,231,896 | B2 * | 3/2019 | Younger | A45B 9/02 |
| 10,285,893 | B1 * | 5/2019 | Sands | A61H 3/04 |
| 10,617,592 | B2 * | 4/2020 | Fellingham | A61H 1/00 |
| 2005/0156395 | A1 | 7/2005 | Bohn | |
| 2014/0296039 | A1 * | 10/2014 | Shaw | A61H 3/04 482/68 |
| 2015/0216757 | A1 * | 8/2015 | Powell | B62B 5/00 280/657 |
| 2016/0287464 | A1 * | 10/2016 | Younger | A61H 3/02 |
| 2019/0105221 | A1 * | 4/2019 | Pan | A61G 5/08 |
| 2020/0155408 | A1 * | 5/2020 | Fathi | A61H 3/04 |
| 2020/0206068 | A1 * | 7/2020 | Fellingham | A61H 3/04 |

OTHER PUBLICATIONS

Amazon.com, "Drive Medical 10210-1 Deluxe Two Button Folding Walker with 5-Inch Wheels," Web Page, <URL:https://www.amazon.com/deluxe-button-folding-walker-5-inch/dp/B001HOM4U2/ref=pd_sbs_121_1?_encoding=UTF8&refRID=RT2KXFES5RNMPGWW8648&th=1/>; Published Dec. 12, 2005, Retrieved from Internet Dec. 29, 2020 (11 pages).

Amazon.com, "Carex 3 Wheel Walker for Seniors, Foldable, Rollator Walker with Three Wheels, Height Adjustable Handles," Web Page, <URL:https://www.amazon.com/walker-wheel-trio-roller-health/dp/B004MCLELQ?SubscriptionId=AKIAIKOHFALUJCKC3KXQ&camp=2025&creative-165953&creativeASIN=B004MCLELQ&linkCode=xm2&tag=bpyahoo-desk-20&m=ATVPDKIKX0DER/<; Published Feb. 4, 2011, Retrieved from Internet Dec. 29, 2020 (12 pages).

1800WheelChair.com, "Urise Stand Up Walker and Assist," Web Page, <URL:http://www.1800wheelchair.com/product/urise-stand-up-walker-and-assistv/>; Retrieved from Internet Dec. 29, 2020 2020 (5 pages).

1800WheelChair.com, "Alpha Rollator," Web Page, <URL:http://www.1800wheelchair.com/product/alpha-rollator/>; Retrieved from Internet Dec. 29, 2020 (5 pages).

RehabMart.com, "Dolomite Alpha Basic and Advanced Walkers," Web Page, <URL:https://www.rehabmart.com/product/dolomite-alpha-basic-and-advanced-walkers-27297.html/>; Retrieved from Internet Dec. 29, 2020 (23 pages).

CaregiverProducts.com, "EVA Adult Pneumativ Support Walker for the Home," Web Page, <URL:https://www.caregiverproducts.com/eva-adult-pneumatic-support-walker-for-home.html/>; Retrieved from Internet Dec. 29, 2020 (14 pages).

TryUpWalker.com, "UPWalker," Web Page, <URL:http://tryupwalker.com/>; Retrieved from Internet Dec. 29, 2020 (9 pages).

eSpecialNeeds.com, "PVC Stand Up Walker," Web Page, <URL:https://www.especialneeds.com/pvc-stand-up-walker.html?m=Configurable_Scp&135=576&aid=134713&utm_source=bing&utm_medium=cpc&utm_campaign=NX_Shopping_Top_Categories1&utm_term=4582764465297576&utm_content=Mobility/>; Retrieved from Internet Dec. 29, 2020 (5 pages).

MedicaleShop.com, "Kaye Medium Anterior Support Walker," Web Page, <URL:http://www.medicaleshop.com/kaye-medium-anterior-support-walker.html?clid=EAlalQobChMl0tavzeTO2AIVhbfsCh1giQDSEAQYBSABEglaDPD_BwE/>; Retrieved from Internet Dec. 29, 2020 (10 pages).

VitalityMedical.com, "Aqua Creek Pool Walker," Web Page, <URL:https://www.vitalitymedical.com/underwater-walker.html?matchtype=&network=s&device=c&adposition=1o20&keyword=&gclid=EalaQobChMlyaz9JfP2AIVEtVkCh0VtZ8EAQYFCABEgJi5fD_BwE/>; Retrieved from Internet Dec. 29, 2020 (4 pages).

MedicalProductsDirect.com, "Stroller Walker by MJM, Rust Proof 3" Twin Casters, Web Page, <URL:https://www.medicalproductsdirect.com/stwabymj3x11.html/>; Retrieved from Internet Dec. 29, 2020 (4 pages).

* cited by examiner

ERGONOMIC AMBULATION ASSIST DEVICE

CROSS-REFERENCE TO RELATED APPLICATIONS

This application claims priority to U.S. Provisional Patent Application No. 62/875,305, filed Jul. 17, 2019. The contents of that application in its entirety are hereby incorporated by reference.

TECHNICAL FIELD

The present disclosure relates generally to a walking assistance device, and more particularly, to an ergonomic ambulation assistance device with a frame for back support and preventing a user from tipping over.

BACKGROUND

Walkers are ambulation assistance devices that have been used to assist patients in walking for decades. Known walkers have a frame with four vertical struts and certain horizontal connection members that support a patient when walking. Generally, a user will hold the frame in front of them and use it as a support as they walk forward. Originally designed to be walked (picked up and moved), these devices have evolved into being slid on the ground with tennis balls on the ends of the struts, or rolled with wheels on the ends of the struts. The rollers or wheels requires a brake or other braking mechanism. More recent walkers also include seats for user comfort, but require a user to perform a 180 degree turn to sit low. Further a walker with a seat makes it difficult for a user to rise back up. Several key issues to support a user and prevent injury while ambulating (devices no longer being walked) have been overlooked with all existing walker models. Some current walker designs cause damage to users due to poor ergonomics while a user is performing rehabilitation or performing everyday activities of daily living (ADL).

One specific problem with present walkers is closed head injuries from users falling backwards. When the majority of persons who are in need of assistance fall backwards, there is nothing on currently used walkers to catch/stop the head of a user from striking what is behind them or the ground. In addition, users falling sideways, especially from twisting, also cause hip or shoulder fractures. Thus, existing walking assistance devices suffer from failure to prevent backward and sideways falls.

A vast majority of walker related falls happen when a user twists or turns while getting into a car, chair, or bed, or changing directions in tighter areas. This requires a user having to leave their support device a few feet away because it cannot be turned in a limited space. For example, rehabilitation experts note that patients fall sideways when feeling weak. Unfortunately, the traditional walkers fail to provide any side support. Experts have noted that patients often break their hips, causing them to fall, as existing walkers do not allow the patient any support to catch themselves. Walkers with front support struts also cause stooping (kyphosis) because they require patients to push their hips backwards, resulting in loss of ergonomic movement using proper alignment with the center of gravity over the user's pelvis for stability.

Many patients needing assistance walking also have comorbidities (other issues) requiring treatment devices, such as intravenous (IV) fluids, feeding tubes, and oxygen (O2) containers. One comorbidity many elderly patients suffer from is rheumatoid arthritis (RA), which is a condition making it extremely difficult to grasp things with hands. Current walkers have hand grips or require gripping bars/frames. In addition, many walkers also require the use of hand brakes for wheels at the base of the frame. When elderly patients lose their balance or have rheumatoid arthritis, they will not immediately brake because of the difficulty in grasping a handle or other brake mechanism.

Known walker frame designs have front structures that cause users to lean forward, causing joint stress in wrists, elbows and shoulders, along with sternal pressure. Sternal pressure in particular can be damaging in particular for cardiovascular (CV) surgical patients who are undergoing rehabilitation.

Currently, the number of home hospitals and long term/monitored living facilities is increasing. These facilities have less care givers available for supervised walking of patients using walking assistance devices. This is also the case with the trend toward direct discharges to home from surgeries in lieu of going to skilled rehabilitation facilities. Further, patients in facilities in hot climates such as Florida or Arizona cannot be out in intense sun for even several minutes without decompensating/having health risk, and thus the lack of shade can be dangerous.

Many walkers have wheels on the exterior of the frame. Such wheels may cause damage to walls and doors, and require braking mechanisms. According to rehabilitation experts, both wheels and brakes are additional components on walkers that may break down or require maintenance. Often, the cost to repair such components is high, often requiring the purchase of whole new devices instead of repairing or replacing the brakes or outside attached wheels. Existing walkers are "one-size-fits-all" regardless of model and thus cannot be adapted to specific therapeutic needs. Existing walkers either have set wheels on back supports, four wheels, or four post legs (with or without tennis balls). Individual patients require different needs such as a patient rehabilitating from a stroke may have hemiparalysis (one side of the body weak/numb than the other side) requiring more support needed on one side of the support device than the other. Patients with an amputated leg are now forced to use wheelchairs because walker devices do not support one side more than the other. Therapists much chose between a walker that has all have the fixed footings (the one-size-fits all) and other devices that are deficient in support.

There are therefore major flaws with current walker devices. For example, current walkers have a lack of support stability from the user's center of gravity being pulled forward, or in front of the pelvis (very often up to 30 or 40 degrees.) This results in less stability or loss of balance, encourages leaning forward with unstable moving of hips backwards, and does not allow patients to recover using the device when balance is lost or they feel weak. This arrangement impedes, or is perceived by a user, to prohibit the natural motion of moving the feet forward, as well as not providing support to prevent sideways and backwards falls. Further, current walkers force a patient to use their hands, wrists and shoulders, causing stress and often resulting in patients being unable to squeeze a brake well or in a timely manner. Walkers with seats are in front of the patient (with the front facing frames), causing lack of support for the user while turning to sit down, when they are most vulnerable to fall. The seats are also low, causing stress and strain, or inability to easily rise back up. The current walker devices also are unable to turn around in tight spaces, causing users to leave the walker behind to get to the toilet, a chair, a bed or a car seat without support, and when many falls occur. Wheels on existing walkers are placed either external to the frame thereby hitting and catching on doors/walls/other impeding items; or on the inside of the frame thereby causing a patient to trip. Both external or internal wheel attachment to frames may loosen and easily break.

Current walker models each have single design, fixed footings. Since all types of surgeries are different, patients have variable footing support needs at different times depending upon fluctuating health conditions. For example, a patient having a new foot surgery and then returning to normal equal balanced walking has different needs than a patient suffering a stroke and then recovering. Currently, patients, especially the elderly, require different types of walkers or use of a wheelchair as their needs change. Current walkers require the use of hands. However, this results in challenges for arthritic patients who cannot use their hands. Many patients with foot surgeries only are prescribed knee rollers which tip over easily, or are put into a wheelchair with a corresponding loss of agility. Experts have cited issues with amputee patients unable to use standard walkers thus forcing them to use a wheelchair, causing contracture of the leg with difficult fitting prosthetics with loss of gravity pull from standing up while moving. Some patients are given knee scooters that tip easily and are very unstable when used with foot surgeries. When upper and lower extremity injuries, such as shoulder and leg surgery, patients cannot use standard walkers because of the need of hands and pressure on shoulders. Further, experts note that many elderly patients who need walkers have fragile skin and suffer from skin tears when catching on frame joints, screws or uneven edges where walkers are meant to fold, seat joints, and braking mechanisms. Current typical walkers cannot be used if a patient has a cast, because when something goes wrong (e.g. loss of balance) there is no easy way for patients to recover their balance-stability.

Thus, there is a need for a walking assistance device that allows a user to position the walker frame rearward allowing for greater safety with mobility. There is also a need for a walking assistance device that includes interchangeable footing devices that may be adapted for different patient needs without the need for multiple walkers. There is also a need for a walking assistance device that provides forearm rests that allow a user support for using their body to move forward with energy flowing through the strong part of the heel of the hands in the correct, ergonomic position. There is also the need for a walker with a higher, resting seat already behind patients for easy rest and then simple rising without strain. There is also a need for a walker device that includes mechanisms for a user to access monitoring and health support apparatuses while they are exerting themselves.

SUMMARY

One disclosed example is a walking assistance device having a pair of forward struts each having a leg supporting a footing device in contact with the ground. The device includes a pair of rear struts each having a leg supporting a footing device in contact with ground. A U-shaped lateral section connects the forward struts with the rear struts. A frame is defined by the lateral section and forward and rear struts, allowing access between the forward struts for a user of the device.

A further implementation of the example device is an embodiment that includes a seat frame including two arms rotationally coupled to the rear struts. A seat having loops is supported by the arms suspended by the seat frame. Another implementation is where the lateral section includes two laterally extending support arm members that each include a forearm support. Another implementation is where each of the support arms include a swivel member allowing the forearm supports to swivel 180 degrees. Another implementation is where each of the forearm supports includes a trough shaped surface for supporting the fore arm of a user. Another implementation is where the trough shaped surface includes a hand support having a heel contact surface for contact with the heel of the hand of the user. Another implementation is where the forearm support includes an attached pocket. Another implementation is where the footing devices are interchangeable. Another implementation is where the footing devices are selected from a group comprising a stopper, a glider, a wheel, a caster wheel, or a wheel in a saucer. Another implementation is where the device includes an anti-tipping bar laterally connected between the rear struts in proximity to the support legs. Another implementation is where the anti-tipping member includes a vertically extending stop member. Another implementation is where the device includes an adjustable support coupled to the lateral frame, the support allowing the installation of a pole accessory. Another implementation is where the pole accessory includes one of a parasol top, an IV bag holder, oxygen machine, feeding bag or pump, or portable heart monitor. Another implementation is where the front struts include an angled section between the leg support and the connection to the respective rear struts. The angled sections each include a handle for supporting a user when the user comes to a standing position.

Another disclosed example is a walking assistance device allowing assistance of a user in walking. The device includes a pair of front struts that include a leg and an angled section. The legs support a footing device in contact with the ground. The device includes a pair of rear struts each including a leg and a cylindrical section. The legs support a footing device in contact with the ground. A pair of side supports each connect the front struts to the rear struts. A U-shaped lateral section connects the forward struts with the rear struts. The lateral section including a pair of arm members extending on each side of the user. A frame is defined by the lateral section and forward and rear struts. The frame allows access between the forward struts for a user of the device.

A further implementation of the example device is an embodiment that includes a seat frame including two arms rotationally coupled to the rear struts. A seat having loops is supported by the arms suspended by the seat frame. Another implementation is where the lateral section includes two laterally extending support arm members. Each of the support arm members include a forearm support including a trough shaped surface for supporting the fore arm of a user. Another implementation is where the footing devices are interchangeable and the footing devices are selected from a group comprising a stopper, a glider, a wheel, a caster wheel, or a wheel in a saucer. Another implementation is where the device includes an anti-tipping bar laterally connected between the rear struts in proximity to the support legs. Another implementation is where the front struts include an angled section between the leg support and the connection to the respective rear struts. The angled sections each include a handle for supporting a user when the user stands.

The above summary is not intended to represent each embodiment or every aspect of the present disclosure. Rather, the foregoing summary merely provides an example of some of the novel aspects and features set forth herein. The above features and advantages, and other features and advantages of the present disclosure, will be readily apparent from the following detailed description of representative embodiments and modes for carrying out the present invention, when taken in connection with the accompanying drawings and the appended claims.

BRIEF DESCRIPTION OF THE DRAWINGS

The disclosure will be better understood from the following description of embodiments together with reference to the accompanying drawings.

Figure 1A:
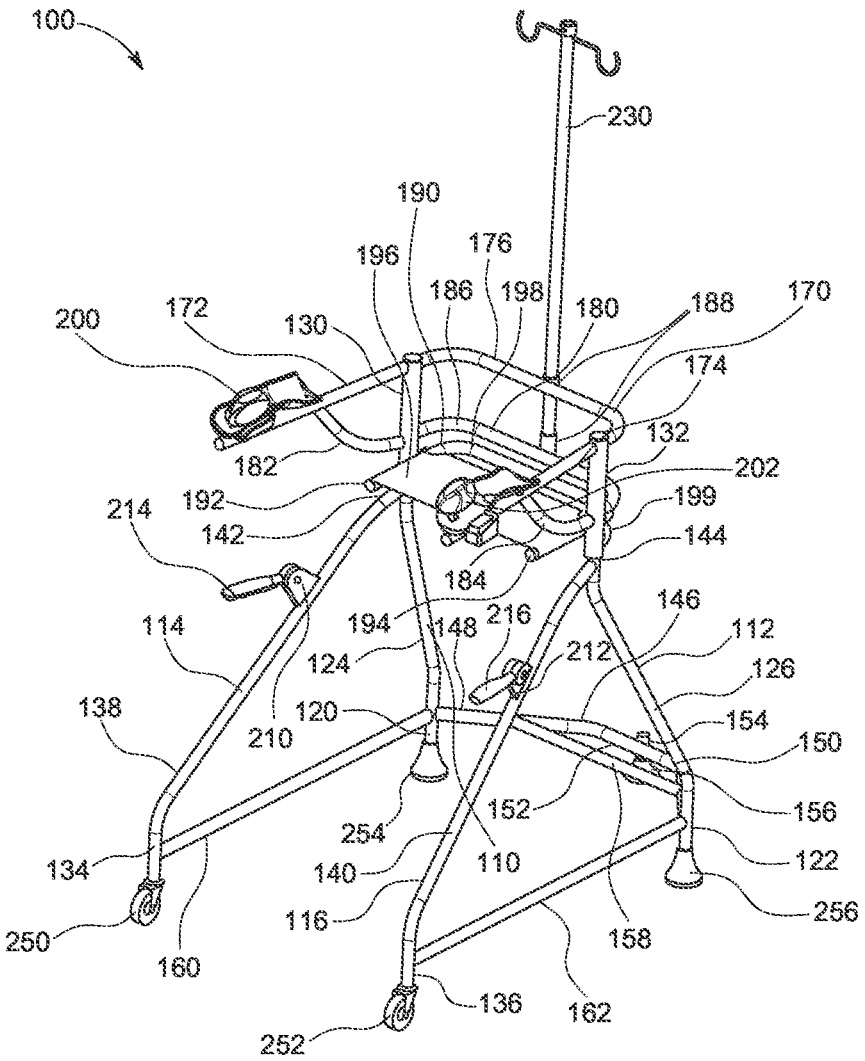
FIG. 1A is a front perspective view of an example ambulation assistance device.

The present disclosure is susceptible to various modifications and alternative forms. Some representative embodiments have been shown by way of example in the drawings and will be described in detail herein. It should be understood, however, that the invention is not intended to be limited to the particular forms disclosed. Rather, the disclosure is to cover all modifications, equivalents, and alternatives falling within the spirit and scope of the invention as defined by the appended claims.

DETAILED DESCRIPTION

The present inventions can be embodied in many different forms. Representative embodiments are shown in the drawings, and will herein be described in detail. The present disclosure is an example or illustration of the principles of the present disclosure, and is not intended to limit the broad aspects of the disclosure to the embodiments illustrated. To that extent, elements and limitations that are disclosed, for example, in the Abstract, Summary, and Detailed Description sections, but not explicitly set forth in the claims, should not be incorporated into the claims, singly or collectively, by implication, inference, or otherwise. For purposes of the present detailed description, unless specifically disclaimed, the singular includes the plural and vice versa; and the word "including" means "including without limitation." Moreover, words of approximation, such as "about," "almost," "substantially," "approximately," and the like, can be used herein to mean "at," "near," or "nearly at," or "within 3-5% of," or "within acceptable manufacturing tolerances," or any logical combination thereof, for example.

One example of the present disclosure is an ambulation assistance device or walker that is light weight and durable. The walker device has four tapered legs that support footings to contact the ground. The tapered legs allow the installation and swapping out of interchangeable types of footing devices, that may be selected according to the needs of the user.

The example walker device has bilateral, ergonomic combination hand and forearm supports in a neutral hand-shake position with a curvature surface for placing the palm of the hand. This allows the user to move the device with moving the body forward pressing with the heel of the hand. The heel of the hand is a very strong part of the body and thus, the example walker device uses pressure applied by the heel of the hand for moving forward encouraging patients to walk straighter and feel supported without pressure on the wrist, elbow, shoulder, hip or knee joints.

The forearm supports swivel and lock of 180 degrees, to position the frame in front or in back of the user for individual needs such as getting out of tight spaces with a support, or going down an incline. The main frame of the example walker has a support slot with a holder for an accessory holder. Examples of such accessories are a removable parasol, an IV pole, an oxygenation device, or a feeding tube. Hand grip handles are mounted extended in the forward struts that assist users to use hand holds while pushing with legs to climb with the device support to rising up (from chairs without arms, beds, toilets, car seats, etc.), along with then pressing on the top front knob of the forearm and hand supports, similar to using a cane top, for being supported to a full standing position.

Figure 1B:
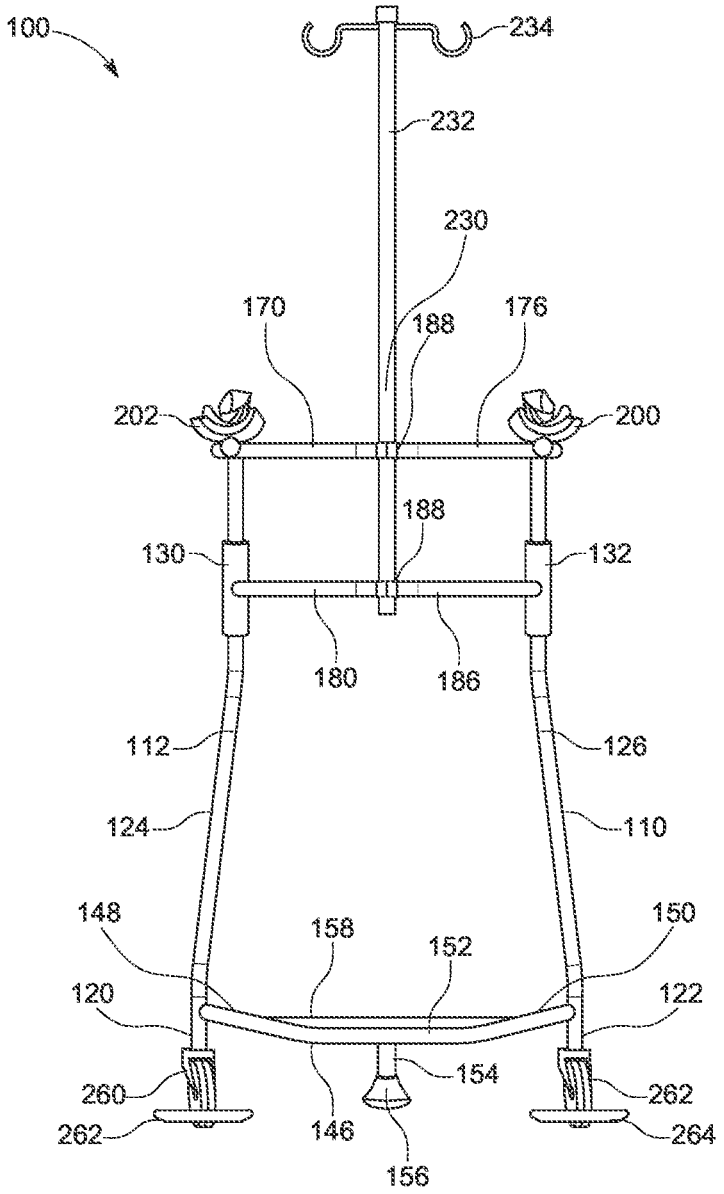
FIG. 1B is a rear view of the example ambulation assistance device in FIG. 1A.

FIG. 1A is a perspective view of the example ambulation assistance device/walker device 100. FIG. 1B is a rear review of the example ambulation assistance device/walker device 100. The ambulation assistance device 100 includes a pair of rear strut members 110 and 112. A corresponding pair of forward strut members 114 and 116 are provided. The rear strut members 110 and 112 each include respective tapered legs 120 and 122, angled middle sections 124 and 126, and upper support cylinders 130 and 132. The support cylinders 130 and 132 are inserted over the opposite end of rear strut members 110 and 112 from the ends attached to the tapered legs 120 and 122.

The forward strut members 114 and 116 include respective tapered legs 134 and 136. The tapered legs 134 and 136 are supported by angled support members 138 and 140. Respective ends 142 and 144 of the support members 138 and 140 are attached to the ends of the middle sections 124 and 126 of the rear strut members 110 and 112. The respective legs 120, 122, 134, and 136 constitute points of contact to the ground for the walker device 100.

A rear anti-tip bar 146 has a first angled horizontal section 148 joined to the tapered leg 120, a second angled horizontal section 150 joined to the tapered leg 122, and a lateral section 152 joined to the first and second sections 148 and 150. The sections 148 and 150 suspend the anti-tip bar 146 to the rear of the rear struts 110 and 112. The lateral section 152 supports a vertical post 154 that contacts the floor if the walker device 100 is tipped backward thus preventing the walker device 100 from tipping further. In this example, the bottom of the vertical post 154 is attached to a stopper 156 with a textured contact surface that grips the ground to stop the walker device 100 from tipping backward. Another lateral support member 158 joins the first and second sections 148 and 150 for additional lateral support of the anti-tip bar 146. As will be explained, the legs 120, 122, 134, and 136 may be attached to different footing devices such as wheels, skids or saucers to provide contact with the ground. A side support 160 joins the leg 134 of the front strut 114 to the leg 120 of the rear strut 110. A side support 162 joins the leg 136 of the front strut 116 to the leg 122 of the rear strut 112.

A U-shaped rear horizontal strut 170 is supported by the top ends of the support cylinders 130 and 132. The rear horizontal strut 170 includes a right side arm member 172 and a left side arm member 174. Each of the members 172 and 174 have a back end joined by a lateral section 176. The opposite front ends of the arm members 172 and 174 extend at approximately the elbow level of a user. A secondary rear strut 180 includes a support member 182 attached between the cylinder 130 and the right side arm member 172. The secondary rear strut 180 includes a support member 184 attached between the cylinder 132 and the left side arm member 174. The support members 182 and 184 provide further support for the respective arm members 172 and 174. A lateral section 186 connects the support members 182 and 184. Rings 188 are attached to the lateral sections 176 and 186. The rings 188 form a socket for an adjustable support with a socket that allows accessories to be inserted in an upright position in the socket.

Figure 1D:
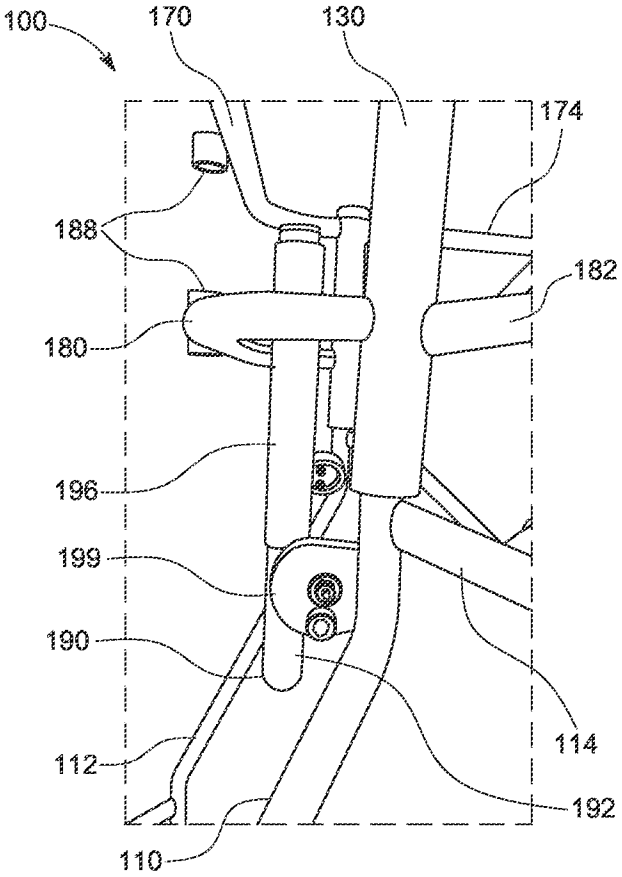
FIG. 1D is a close-up view of the lateral support structures with the seat in the up position.
Figure 1C:
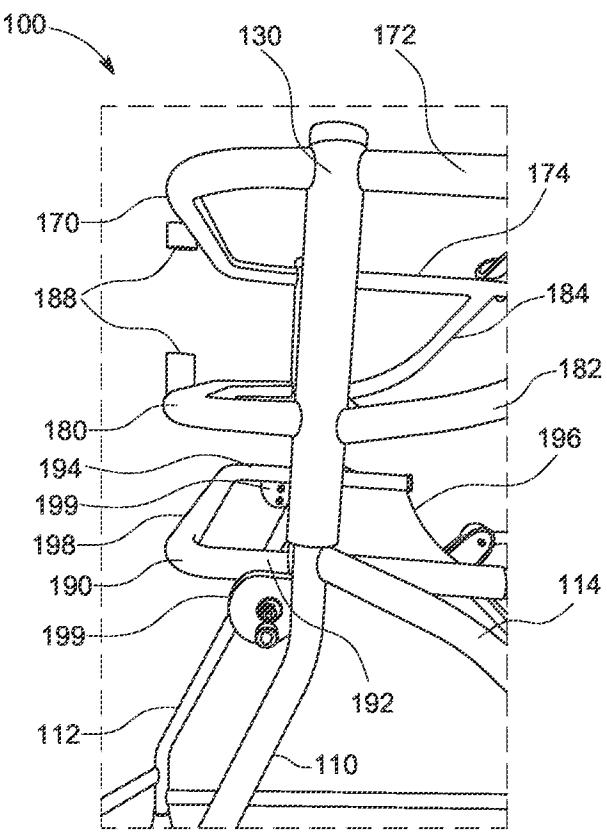
FIG. 1C is a close-up view of the lateral support structures and seat of the example ambulation assistance device in FIG. 1A.

As shown in greater detail in FIG. 1C, a seat support frame 190 includes extending parallel arms 192 and 194. A rectangularly shaped sling style seat 196 has loops on either side. The loops are inserted from the distal ends of the arms 192 and 194 such that the seat 196 is supported by the arms 192 and 194. The seat 196 may be fabricated from an appropriate material such as canvas for easy cleaning. A back seat lateral member 198 joins the arms 192 and 194. The opposite proximal ends of the arms 192 and 194 are joined by the lateral member 198. Outward extending pins are attached to each of the arms 192 and 194 in proximity to the proximal ends. The pins are rotationally attached to mounting tabs 199 that are formed on the rear strut members 110 and 112 just below the cylinders 130 and 132.

In this example, the sling style seat 196 is placed relatively high on the walker device by the frame 190 for easy resting of the user. Thus, the seat 196 is positioned at roughly the top of the thigh of a user. The seat frame 190 may be adjusted to position the seat at the top of the thigh of the user. The seat 196 may be rotated down to rest in position or rotated upwards on the pins of the arms 192 and 194 from the tabs 199. When the seat 196 is rotated upward as shown in FIG. 1D, it is out of the way of the user. The seat 196 may thus easily be rotationally positioned by the user while being within the support of the walker device 100. Users do not have to lower themselves, as required by standard chairs or seats, thereby eliminating difficulties in standing back up. The user of the example walker 100 simply rests down a few inches.

An optional, removable foot rest accessory may be attached across the forward strut members 114 and 116 and supported by the side supports 160 and 162 if a user needs pressure released on their hips when resting, and/or to avoid blood/fluid pooling in their lower legs. The higher position of the seat 196 allows resting by the user. The user may easily stand by simply straightening their knees. The seat 196 can be flipped down or raised up with one hand while user is standing in the walker device 100.

In this example, the various struts, members, sections and arms of the walker device 100 are fabricated from a light weight but relatively strong metal such as aluminum. However, other suitable materials may be used such as titanium, steel, or fiber filled 3D printed plastic and the like. The different components are joined by smooth welding, but other connection methods such as rivets, screws, fasteners, and the like may be used with smooth plastic coverings to avoid pinching or teaming of skin.

The example walker device 100 is an ergonomic ambulation assist device. The example walker device 100 has ergonomic placement and accommodates the natural kinetic energy of the body when ambulating. An optional support attached to the accessory cylinder 188 allows the incorporation of diagnostic and treatment equipment. The structural members of the device 100 assist the user with sitting, rising, resting, standing, walking and lowering movements.

The right arm member 172 includes a right forearm support 200 while the left arm member 174 includes a left handhold 202. As will be explained below, the right forearm support 200 is mounted to rotate 180 degrees relative to the right arm member 172. Similarly, the left forearm support 202 is mounted to rotate 180 degrees relative to the left arm member 174. The angled sections 138 and 140 of the respective forward struts 114 and 116 each mount a handle assembly 210 and 212. In this example, each of the handle assemblies 210 and 212 support a respective handle 214 and 216 that extend outward from the respective sections 138 and 140. In this example, the handles 214 and 216 may be rotated at different angles, but the handles 214 and 216 may also be fixed in a pre-determined angular position. The handles 214 and 216 allow a user to support themselves when standing up to the operating position of the walker device 100 or to support themselves when lowering themselves out of the walker device 100. The handles 214 and 216 are referred to as a "giddy up" handle in the therapy field as they assist a user when the user comes to a standing position. Alternatively, the handles 214 and 216 may be used by a user to hang items with straps such as tote bags.

The user is positioned within a frame defined by the front struts 114 and 116, rear struts 110 and 112, rear horizontal strut 170, and the side supports 160 and 162. A user thus positions themselves between the front struts 114 and 116 defining the front of the frame. A user may then use the handles 214 and 216 to assist with rising up toward a standing position. The user may then place their hands on the front "cane top" of the supports 200 and 202 as support to complete standing to a full upright position. The user can then use the rear strut members 110 and 112 as support for turning around with support of the walker device 100. This is in contrast with the majority of current walkers that force users to turn without support and away from support, often twisting their bodies. Current walkers also do not have any mechanism to assist users with rising from low positions. The structure of the example walker device 100 allows the frame to be located behind the user with the anti-tip bar 146 preventing backward tipping. The frame support of the rear struts 110 and 112 and horizontal strut 170 is located behind a user, and the forearm supports 200 and 202 may be rotated 180 degrees to allow a user use with the device in front to be supported getting out of tight spaces or if needed more support in front going down inclines. This prevents common problems in tight spaces (e.g. a wall, toilet, bed) when users leave the walker device 100 farther away because they cannot turn it in confined spaces.

Figure 2A:
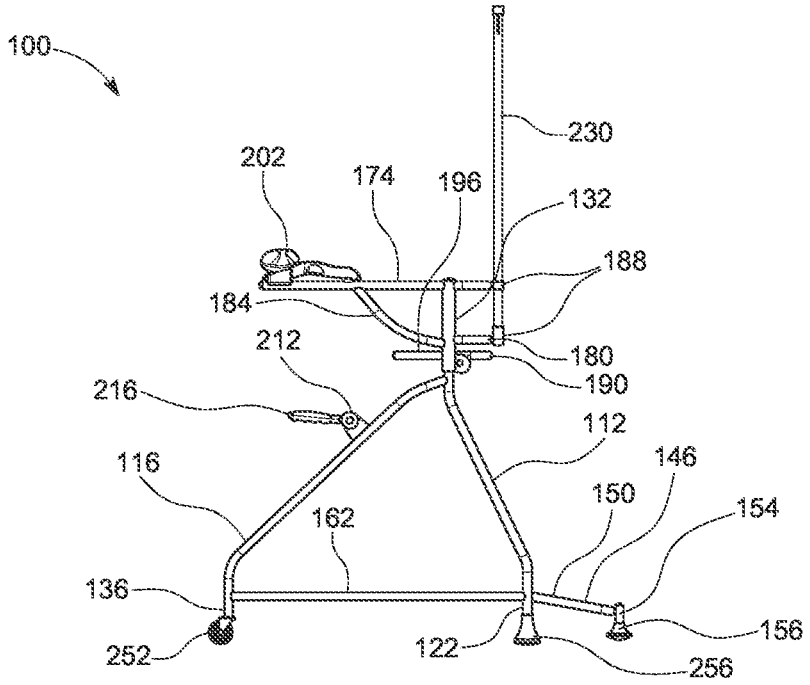
FIG. 2A is a side view of the example ambulation assistance device in FIG. 1A showing a vertical accessory holder.

The example walker device 100 has an optional, removal adjustable accessory support 230 that may be inserted in the rings 188. FIG. 2A is a side view of the example ambulation assistance device 100 with the accessory support 230 inserted in the rings 188. The support 230 has variable height adjustment, and allows pole type accessories to hang or attach medical equipment, and other components as a shade parasol to protect a user when walking outside. For example, as shown in FIG. 1A, the accessories may include an intravenous pole 232 that includes hooks 234 for suspending IV bags or other devices such as a feeding tube, or an oxygenation device (e.g. a portable oxygen concentrator). Other types of accessories may be attached to the accessory socket 188 via a pole.

Figure 2B:
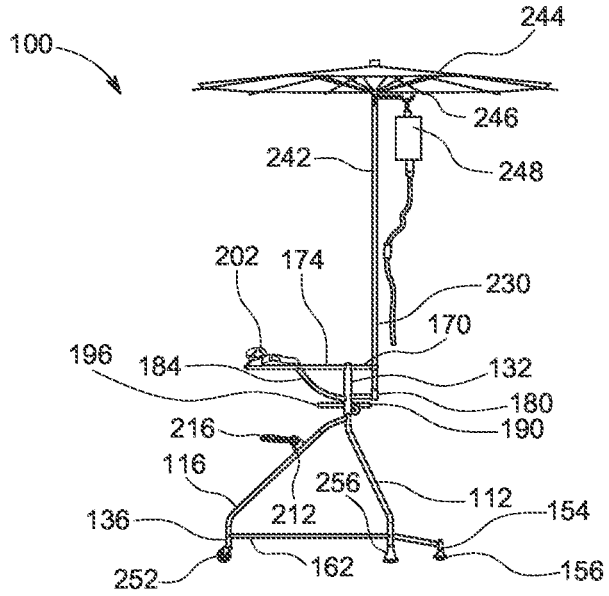
FIG. 2B is a side view of the example ambulation assistance device with an example accessory attached on the vertical accessory holder.

FIG. 2B is a side view of the example ambulation assistance device 100 with an example parasol accessory 240 attached to the top of the accessory support 230. The parasol accessory 240 includes a support pole 242 that is inserted in the socket of the accessory support 230. The other end of the support pole 242 supports a retractable parasol 244 that may provide shade for a user. Of course, other attachments may be used with the support pole 242 such as an oxygenation device (e.g. a portable oxygen concentrator) or a feeding tube may be supported by a pole similar to the support pole 242 held by the accessory support 230.

As will be detailed, the supports 200 and 202 are shaped as an arm-hand holder/resting trough in a natural, correct neutral position to allow a user to move the walker device 100 with the body, using the heel of the hand in conjunction with the forearm. The "handshake" position prevents nerve issues (e.g. carpal tunnel) and encourages the user into a more upright position because they are pushing through the heel of the hand versus stooping forward, removing sternal and joint pressure. The supports 200 and 202 are removable for cleaning and are fabricated from durable material such as plastic or a suitable alternative.

Figure 3A:
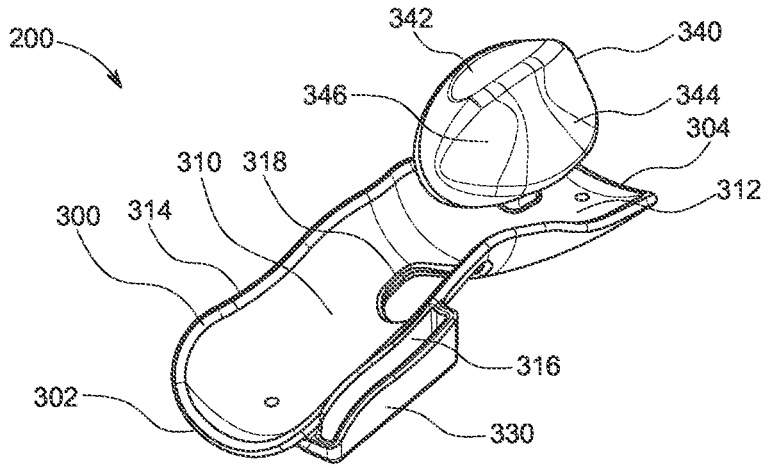
FIG. 3A is a perspective view of the right forearm and hand support of the example ambulation assistance device in FIG. 1A.
Figure 3B:
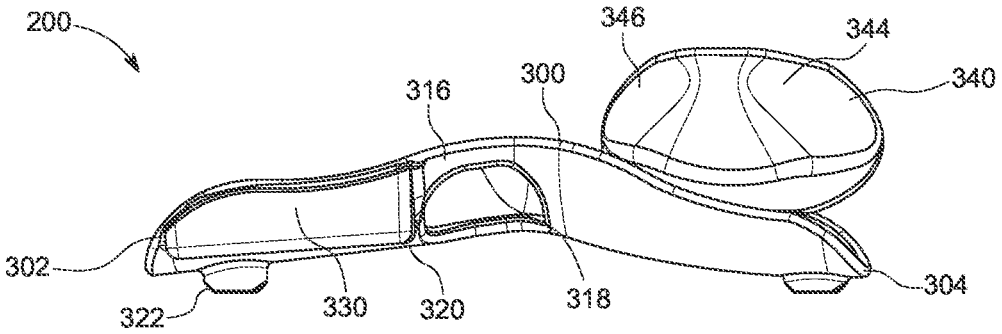
FIG. 3B is an outside side view of the forearm and hand support in FIG. 3A.
Figure 3C:
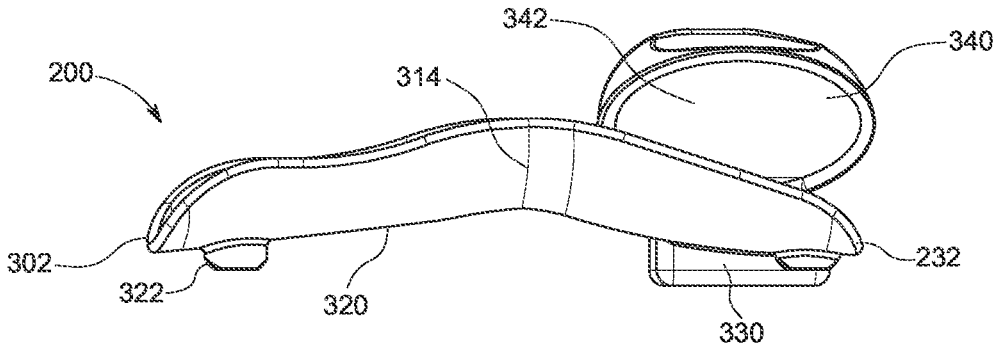
FIG. 3C is an inside side view of the forearm and hand support in FIG. 3A.

FIG. 3A is a perspective view of the right forearm and hand support 200 of the ambulation assistance device 100 in FIG. 1A. FIG. 3B is an outside side view of the right forearm support 200, and FIG. 3C is an inside side view of the right forearm support 200. As shown in FIGS. 3A-3C, the right handhold 200 thus includes a lateral body 300 with opposing proximal and distal ends 302 and 304. The body 300 defines a resting surface 310 that defines an ergonomically shaped trough 312 defined by an inner wall 314 and an outer wall 316. The trough 312 slopes down from an elevated midpoint toward the proximal end 302 and the distal end 304. The trough 312 has a through notch 318 for the pisiform/wrist bone of the right hand. The trough 312 curves up in a "U" shape to cradle the forearm and hand without joint stress.

An opposite lower surface 320 mounts a cylindrical support 322 in proximity to the proximal end 302. As explained above, the right handhold 200 may be swiveled 180 degrees to reorient the distal end 304 around the cylindrical support 322. An optional side pocket 330 is attached to the outside of the outer wall 316. The side pocket 330 is about half the length of the handhold 200 to allow the storage of diagnostic instruments such as portable heart electrocardiograms (ECG) reader, a blood pressure cuff and monitor, or thermometers and the like. Of course, other items may be stored in the side pocket 330.

A hand support 340 is mounted near the distal end 304. The hand support 340 has two ergonomic outer surfaces 342 and 344 opposite each other. The top edges of the outer surfaces 342 and 344 are shaped similar to a cane top to allow a user to rest their hand. A heel contact surface 346 between the surfaces 342 and 344 allows a user to apply pressure through the heel of their right hand. In this example, the hand support 340 is fabricated from a soft material such as foam that allows a user to grip the support 340. The arm position of the right arm in the trough 312 and the hand support 340 is a natural "hand shake" correct ergonomic position with a relaxed hand thumb side up avoiding carpal tunnel issues. Thus, the right hand is rested on the outer surface 344 with the thumb resting on the top of the hand support 340. The heel of the right hand is placed in proximity to the heel contact surface 346 to allows pressure to be applied for movement of the walker device 100.

Figure 4A:
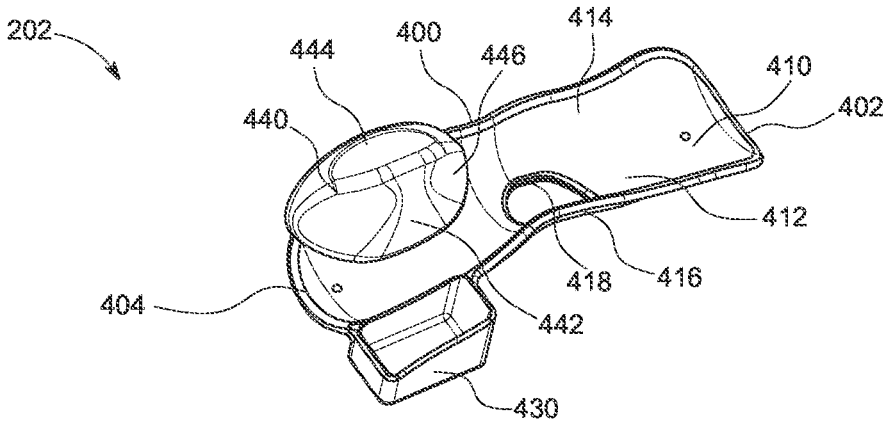
FIG. 4A is a perspective view of the left forearm and hand support of the example ambulation assistance device in FIG. 1A.
Figure 4B:
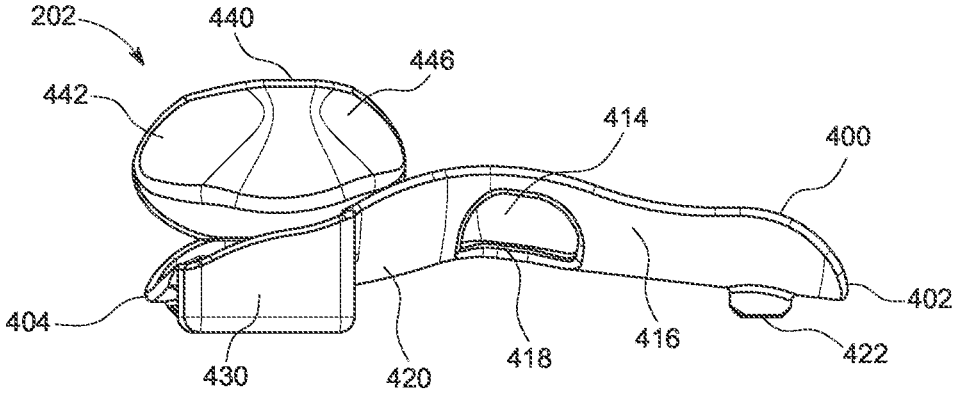
FIG. 4B is an outside side view of the forearm and hand support in FIG. 4A.
Figure 4C:
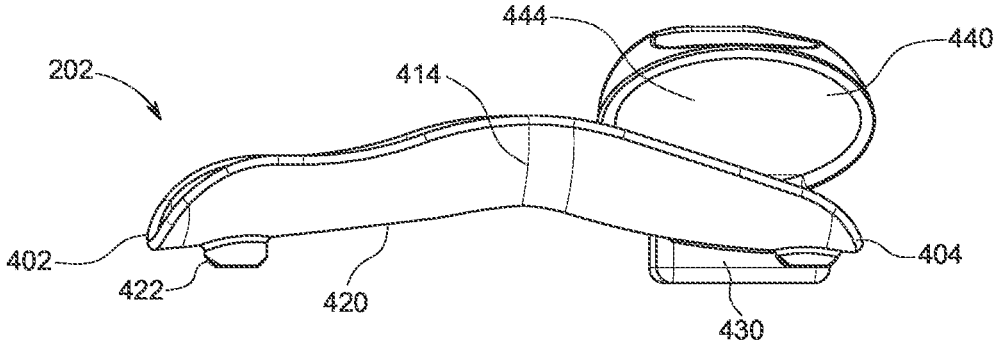
FIG. 4C is an inside side view of the forearm and hand support in FIG. 4A.

FIG. 4A is a perspective view of the left forearm and hand support 202 of the example ambulation assistance device 100. FIG. 4B is an outside side view of the left forearm support 202 and FIG. 4C is an inside side view of the left forearm support 202. As shown in FIGS. 4A-4C, the left handhold 202 includes a lateral body 400 with opposing proximal and distal ends 402 and 404. The lateral body 400 defines a resting surface 410 that defines an ergonomically shaped trough 412 defined by an inner wall 414 and an outer wall 416. The trough 412 slopes down from an elevated midpoint toward the proximal end 402 and the distal end 404. The trough 412 has a through notch 418 for the pisiform/wrist bone of the left hand. The trough 412 curves up in a "U" shape to cradle the forearm and hand without joint stress.

An opposite lower surface 420 mounts a cylindrical support 422 in proximity to the proximal end 402. As explained above, the left handhold 400 may be swiveled 180 degrees to reorient the distal end 404 around the cylindrical support 422. An optional side pocket 430 is attached to the outside of the exterior wall 416 to allow the storage of items. In this example, the side pocket 430 has different dimensions than the pocket 330 in FIG. 3A allowing the storage of different types of medical devices. The different medical devices may include a pulse oximeter to monitor oxygenation/decompensation. It is to be understood that the side pockets 330 and 430 may be of any convenient size and be either the same dimensions or different dimensions. The side pockets 330 and 430 may be located anywhere along the side of the respective troughs 312 and 412. For example, the side pocket 430 is located closer to the end of the trough 412 near a user's hand to allow access to a pulse oximeter.

A hand support 440 is mounted near the distal end 404. The hand support 440 has two ergonomic outer surfaces 442 and 444 opposite each other. The top edges of the outer surfaces 442 and 444 are shaped similar to a cane top to allow a user to rest their left hand. A heel contact surface 446 between the surfaces 442 and 444 allows a user to apply pressure through the heel of their left hand. The arm position of the left arm in the trough 412 and the hand support 440 is a natural "hand shake" correct ergonomic position with a relaxed hand thumb side up avoiding carpal tunnel issues. Thus, the left hand is rested on the outer surface 442 with the thumb resting on the top of the hand support 440. The heel of the left hand is placed in proximity to the heel contact surface 446 to allows pressure to be applied for movement of the walker device 100.

Each of the tapered legs 120, 122, 134, and 136 may be attached to different types of footing devices that have a common attachment mechanism. As explained above, different footing devices may be installed on each of the legs 120, 122, 134, and 136 based on the needs of the user. In the example shown in FIG. 1A and FIG. 2A, caster wheels 250 and 252 are installed on the front tapered legs 134 and 136. Conically shaped gliders 254 and 256 are attached to the back tapered legs 120 and 122. In this example, the gliders 254 and 256 have substantially smooth ground contact surfaces to allow the glider 254 and 256 to glide along the ground.

Directly under all four tapered legs 120, 122, 134, and 136, therapists/users can interchange any combination of footing devices such as stoppers, wheels, gliders, caster wheels, a saucer type ball roller, a caster wheel with a protective saucer, or customization of footing devices. It is to be understood, that caster wheels such as the caster wheel 250 may be attached to all of the legs 120, 122, 134, and 136. Alternatively, gliders such as the glider 254 may be installed on all of the legs 120, 122, 134, and 136.

Figure 5A:
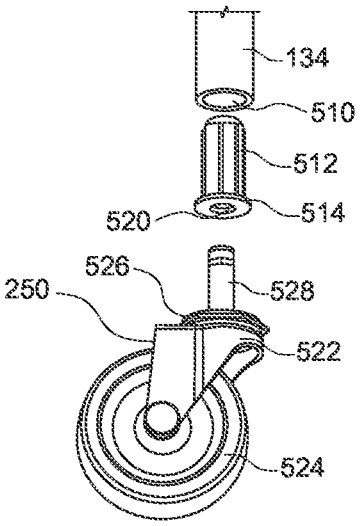
FIG. 5A is a perspective exploded view of a wheel footing device that may be attached to the legs of the ambulation assistance device in FIG. 1A.

FIG. 5A is an exploded perspective view of the attachment of the caster wheel 250 to the leg 134 in FIG. 1A. The leg 134 includes an open end 510. A mating cylindrically shaped insert 512 has a friction fit exterior surface that holds the insert 512 in the leg 134. The insert 512 is inserted through the open end 510. The insert 512 includes an annular collar 514 that defines a circular socket 520. The example caster wheel 250 includes a fork 522 that holds an axle for rotationally mounting a wheel 524. The fork 522 is rotationally mounted from a base member 526. A connector 528 that may be inserted in the socket 520 extends from the base member 526 to fix the wheel 250 to the leg 134. As explained above, any footing device with a connector similar to the connector 528 may be attached to the leg 134. The caster wheel 250 may thus be interchangeably attached to any of the legs such as the leg 134.

Figure 5B:
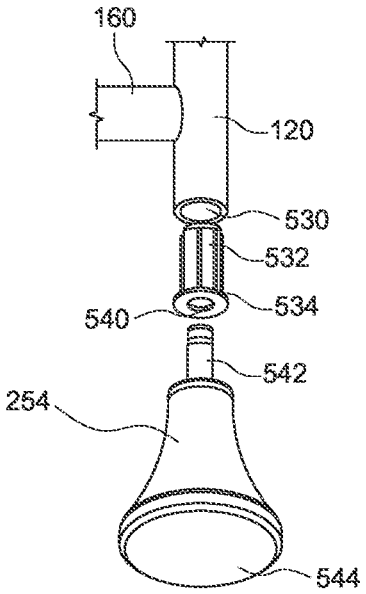
FIG. 5B is a perspective exploded view of a glider type footing device that may be attached to the legs of the ambulation assistance device in FIG. 1A.

FIG. 5B is an exploded perspective view of the attachment of the glider 254 to the leg 120 in FIG. 1B. The leg 120 includes an open end 530. A mating cylindrically shaped insert 532 has a friction fit exterior surface that holds the insert 532 into the open end 530. The insert 532 includes an annular collar 534 that defines a circular socket 540. The glider 254 is conically shaped with a connector 542 that is inserted in the socket 540. An opposite flat end 544 allows smooth contact with surfaces such as carpet to allow a gliding motion. The glider 254 may thus be interchangeably attached to any of the legs such as the leg 120.

Figure 5C:
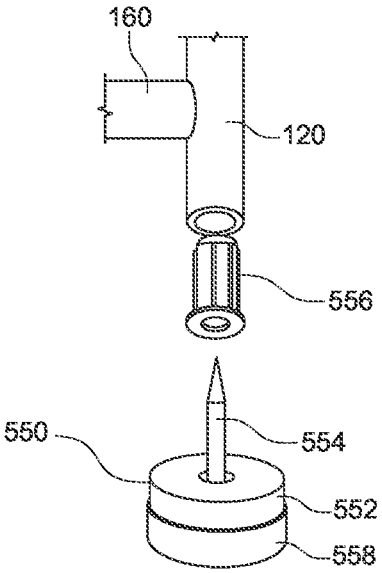
FIG. 5C is a perspective exploded view of another type of glider footing device that may be attached to the legs of the ambulation assistance device in FIG. 1A.

FIG. 5C shows another type of glider 550 in relation to the leg 120 in FIG. 1B. The glider 550 has a cylindrical body 552 including a connector 554 on one end that may be mated to an insert 556 in the leg 120. The opposite end includes a circular domed surface 558 that is smooth and allows contact to glide along ground surfaces. The glider 550 may thus be interchangeably attached to any of the legs such as the leg 120.

Any combination of footing devices such as a glider, different sized caster wheels, an auto recess/break ball-wheel, or other customized footing devices may be installed on one or more of the legs 120, 122, 134, and 136. For example, FIG. 1B shows the installation of caster type wheels 260 and 262 attached to the rear tapered legs 134 and 136. The caster wheels 260 and 262 may be swiveled allowing more maneuverability of the example walker device 100. In this example, the caster wheels 260 and 262 also support respective saucers 264 and 266 that protect the legs 120 and 122 from contacting surfaces. The footing devices may be selected to customize the walker device 100 for individual needs, surgeries, environments to give control to therapists and users versus a "one-size-fits-all" type of footing device on current walkers.

The terminology used herein is for the purpose of describing particular embodiments only, and is not intended to be limiting of the invention. As used herein, the singular forms "a," "an," and "the" are intended to include the plural forms as well, unless the context clearly indicates otherwise. Furthermore, to the extent that the terms "including," "includes," "having," "has," "with," or variants thereof, are used in either the detailed description and/or the claims, such terms are intended to be inclusive in a manner similar to the term "comprising."

Unless otherwise defined, all terms (including technical and scientific terms) used herein have the same meaning as commonly understood by one of ordinary skill in the art. Furthermore, terms, such as those defined in commonly used dictionaries, should be interpreted as having a meaning that is consistent with their meaning in the context of the relevant art, and will not be interpreted in an idealized or overly formal sense unless expressly so defined herein.

While various embodiments of the present invention have been described above, it should be understood that they have been presented by way of example only, and not limitation. Although the invention has been illustrated and described with respect to one or more implementations, equivalent alterations and modifications will occur or be known to others skilled in the art upon the reading and understanding of this specification and the annexed drawings. In addition, while a particular feature of the invention may have been disclosed with respect to only one of several implementations, such feature may be combined with one or more other features of the other implementations as may be desired and advantageous for any given or particular application. Thus, the breadth and scope of the present invention should not be limited by any of the above described embodiments. Rather, the scope of the invention should be defined in accordance with the following claims and their equivalents.

What is claimed is:

1. A walking assistance device comprising:

a first and second forward strut each having a leg supporting a footing device in contact with a ground surface;

a first and second rear strut each having a leg supporting a footing device in contact with the ground surface;

a first rear horizontal strut having two laterally extending side arm members;

a first and second upper support cylinder, the first upper support cylinder connecting the first forward strut with the first rear strut and connecting the first forward and rear struts with the first rear horizontal strut, the second upper support cylinder connecting the second forward strut with the second rear strut and connecting the second forward and rear struts with the first rear horizontal strut, wherein each of the side arm members comprises a forearm support having a hand support, the hand support having a heel contact surface, and the forearm support and the hand support together positioning the heel contact surface for contact with a heel of a hand of a user and forcing the hand to a handshake position, wherein the forward and rear struts each comprise an angled section between the respective portion of the leg supporting the respective footing device and the respective connection to the first rear horizontal strut, and a second rear horizontal strut having two support members, each support member connecting the respective side arm member with the respective upper support cylinder, and the second rear horizontal strut connecting the first upper support cylinder with the second upper support cylinder, wherein the first and second rear horizontal struts and the forward and rear struts together allow access between the forward struts for the user of the device.

2. The walking assistance device of claim 1, further comprising:

a seat frame comprising two arms rotationally coupled to the rear struts; and a retractable seat supported by the arms suspended by the seat frame.

3. The walking assistance device of claim 1, wherein each of the side arms comprises a swivel member allowing the forearm supports to swivel 180 degrees in a horizontal plane parallel to the ground surface.

4. The walking assistance device of claim 1, wherein each of the forearm supports comprises a trough shaped surface configured to cradle a forearm and the respective hand of the user.

5. The walking assistance device of claim 4, wherein each of the forearm supports comprise proximal and distal ends, and wherein the trough shaped surface slopes from an elevated midpoint toward the proximal and distal ends.

6. The walking assistance device of claim 4, wherein the trough shaped surface comprises a through notch configured to accommodate one or more wrist bones of the user.

7. The walking assistance device of claim 1, wherein the forearm support comprises an attached pocket.

8. The walking assistance device claim 1, wherein the footing devices are interchangeable.

9. The walking assistance device of claim 1, wherein the footing devices are selected from the group consisting of a stopper, a glider, a wheel, a caster wheel, or a wheel in a saucer.

10. The walking assistance device of claim 1, further comprising:

an anti-tipping bar laterally connected between the rear struts in proximity to the support legs, wherein the anti-tipping bar comprises a vertically extending stop member, and wherein an air gap exists between the ground surface and the vertically extending stop member when each of the four footing devices is in contact with the ground surface.

11. The walking assistance device of claim 1, further comprising an adjustable support coupled to the first and second rear horizontal struts, the support allowing the installation of a pole accessory.

12. The walking assistance device of claim 11, wherein the pole accessory comprises a parasol top.

13. The walking assistance device of claim 1, wherein each hand support further comprises first and second outer surfaces, wherein each hand support is ergonomically formed of a soft material, wherein each hand support is configured to form a handshake with one of the hands of the user, wherein the first outer surface is ergonomically configured to receive a thumb of the user, wherein the second outer surface is ergonomically configured to receive one or more fingers of the user, and wherein the heel contact surface is located between the first and second outer surfaces.

14. A walking assistance device comprising:

a first and second forward struts each having a leg supporting a footing device in contact with a ground surface;

a first and second rear struts each having a leg supporting a footing device in contact with the ground surface;

a first rear horizontal strut;

a first and second upper support cylinder, the first upper support cylinder connecting the first forward strut with the first rear strut and connecting the first forward and rear struts with the first rear horizontal strut, the second upper support cylinder connecting the second forward strut with the second rear strut and connecting the second forward and rear struts with the first rear horizontal strut, herein the first rear horizontal strut comprises a pair of side arm members extending on each side of the user and a pair of forearm supports each having a hand support, the hand support having a heel contact surface, and the forearm support and the hand support together positioning the heel contact surface for contact with a heel of a hand of the user and forcing the hand to a handshake position, wherein each hand support is ergonomically formed of a soft material, and wherein each hand support is configured to form a handshake with one of the hands of the user; and a second rear horizontal strut having two support members, each support member connecting the respective side arm member with the respective upper support cylinder, and the second rear horizontal strut connecting the first upper support cylinder with the second upper support cylinder, wherein the first and second rear horizontal struts and the forward and rear struts together allowing access between the forward struts for the user of the device.

15. A walking assistance device allowing assistance of a user in walking, the device comprising:

a first and second forward struts, each of the struts comprising a leg and an angled section, wherein the leg supports a footing device in contact with a ground surface;

a first and second rear struts, each of the rear struts comprising a leg, an angled section, and a cylindrical section, wherein the leg supports a footing device in contact with the ground surface;

a pair of side supports, each connecting the forward struts to the rear struts;

a first rear horizontal strut;

a first and second upper support cylinder, the first upper support cylinder connecting the first forward strut with the first rear strut and connecting the first forward and rear struts with the first rear horizontal strut, the second upper support cylinder connecting the second forward strut with the second rear strut and connecting the second forward and rear struts with the first rear horizontal strut, wherein the first rear horizontal strut comprises a pair of side arm members extending on each side of the user and a pair of forearm supports each having a hand support, the hand support having a heel contact surface, and the forearm support and the hand support together positioning the heel contact surface for contact with a heel of a hand of the user and forcing the hand to a handshake position, and a second rear horizontal strut having two support members, each support member connecting the respective side arm member with the respective upper support cylinder, and the second rear horizontal strut connecting the first upper support cylinder with the second upper support cylinder, wherein the first and second rear horizontal struts and the forward and rear struts together allowing access between the forward struts for the user of the device.

16. The walking assistance device of claim 15, further comprising:

a seat frame comprising two arms rotationally coupled to the rear struts; and a seat having loops supported by the arms suspended by the seat frame.

17. The walking assistance device of claim 15, wherein the forearm support comprises a trough shaped surface is configured to cradle the forearm and the respective hand of the user.

18. The walking assistance device claim 15, wherein the footing devices are interchangeable, and wherein the footing devices are selected from the group consisting of a stopper, a glider, a wheel, a caster wheel, or a wheel in a saucer.

19. The walking assistance device of claim 15, further comprising an anti-tipping bar laterally connected between the rear struts in proximity to the support legs, wherein an air gap exists between the ground surface and the anti-tipping bar when each of the four footing devices is in contact with the ground surface.

20. The walking assistance device of claim 15, wherein each of the forward struts comprises an angled section between the leg support and the connection to the respective rear struts, and wherein each of the angled sections comprises a handle extending from the angled section for supporting a user when the user stands.

* * * * *